US007235164B2

(12) United States Patent
Anex et al.

(10) Patent No.: US 7,235,164 B2
(45) **Date of Patent: *Jun. 26, 2007**

(54) ELECTROKINETIC PUMP HAVING CAPACITIVE ELECTRODES

(75) Inventors: Deon S. Anex, Livermore, CA (US); Phillip H. Paul, Livermore, CA (US); David W. Neyer, Castro Valley, CA (US)

(73) Assignee: Eksigent Technologies, LLC, Dublin, CA (US)

( * ) Notice: Subject to any disclaimer, the term of this patent is extended or adjusted under 35 U.S.C. 154(b) by 385 days.

This patent is subject to a terminal disclaimer.

(21) Appl. No.: 10/273,723

(22) Filed: Oct. 18, 2002

(65) Prior Publication Data

US 2004/0074768 A1 Apr. 22, 2004

(51) Int. Cl.
*C25B 9/00* (2006.01)
*H22K 44/00* (2006.01)

(52) U.S. Cl. ..... 204/600; 204/601; 204/627; 417/48

(58) Field of Classification Search ..... 204/242, 204/263–266, 275.1, 252, 630, 645, 647, 204/550, 600, 601, 627; 205/674; 361/302, 361/352; 607/119–121; 417/48
See application file for complete search history.

(56) References Cited

U.S. PATENT DOCUMENTS

| | | | | |
|---|---|---|---|---|
| 1,063,204 | A | 6/1913 | Kraft | |
| 2,615,940 | A | 10/1952 | Williams | 171/330 |
| 2,644,900 | A | 7/1953 | Hardway | 310/2 |
| 2,644,902 | A | 7/1953 | Hardway | 310/2 |
| 2,661,430 | A | 12/1953 | Hardway | 310/2 |
| 2,995,714 | A | 8/1961 | Hannah | 331/107 |
| 3,143,691 | A | 8/1964 | Hurd | 317/231 |
| 3,209,255 | A | 9/1965 | Estes et al. | 324/94 |
| 3,298,789 | A | 1/1967 | Mast et al. | |
| 3,427,978 | A | 2/1969 | Hanneman et al. | 103/1 |
| 3,544,237 | A | 12/1970 | Walz | 417/48 |
| 3,630,957 | A | 12/1971 | Rey et al. | |
| 3,682,239 | A | 8/1972 | Abu-Romia | 165/1 |
| 3,923,426 | A * | 12/1975 | Theeuwes | 204/630 |

(Continued)

FOREIGN PATENT DOCUMENTS

| | | |
|---|---|---|
| CN | 2286429 Y | 7/1998 |
| EP | 0421234 A2 | 10/1991 |
| EP | 1063204 A2 | 12/2000 |
| JP | 03-087659 | 4/1991 |
| WO | WO 96/39252 | 12/1996 |

(Continued)

OTHER PUBLICATIONS

Adamson A.W. et al., *Physical Chemistry of Surfaces*, pp. 185-187 (Wiley, NY 1997), no month.

(Continued)

*Primary Examiner*—Roy King
*Assistant Examiner*—Lois Zheng
(74) *Attorney, Agent, or Firm*—Anna Lynne Heinkel; Sheldon, Mak, Rose & Anderson

(57) ABSTRACT

An electrokinetic pump achieves high and low flow rates without producing significant gaseous byproducts and without significant evolution of the pump fluid. A first feature of the pump is that the electrodes in the pump are capacitive with a capacitance of at least $10^{-4}$ Farads/cm$^2$. A second feature of the pump is that it is configured to maximize the potential across the porous dielectric material. The pump can have either or both features.

24 Claims, 8 Drawing Sheets

U.S. PATENT DOCUMENTS 4,383,265 A * 5/1983 Kohashi ..... 347/55
4,396,925 A 8/1983 Kohashi
4,402,817 A * 9/1983 Maget ..... 204/265
4,999,069 A 3/1991 Brackett et al.
5,037,457 A 8/1991 Goldsmith et al.
5,041,181 A 8/1991 Brackett et al.
5,087,338 A * 2/1992 Perry et al. ..... 435/173.2
5,126,022 A 6/1992 Soane et al.
5,534,328 A 7/1996 Ashmead et al.
5,573,651 A 11/1996 Dasgupta et al. ..... 204/601
5,581,438 A 12/1996 Halliop
5,683,443 A * 11/1997 Munshi et al. ..... 607/121
5,858,193 A 1/1999 Zanzucchi et al. ..... 204/601
5,888,390 A 3/1999 Craig
5,942,093 A 8/1999 Rakestraw et al. ..... 204/450
5,958,203 A 9/1999 Parce et al.
RE36,350 E 10/1999 Swedberg
5,961,800 A 10/1999 McBride et al. ..... 204/450
5,964,997 A 10/1999 McBride
5,989,402 A 11/1999 Chow et al.
5,997,708 A 12/1999 Craig
6,007,690 A 12/1999 Nelson et al.
6,012,902 A 1/2000 Parce ..... 417/48
6,013,164 A 1/2000 Paul et al. ..... 204/450
6,019,882 A 2/2000 Paul et al. ..... 204/450
6,054,034 A 4/2000 Soane et al.
6,068,243 A 5/2000 Hoggan
6,068,767 A 5/2000 Garguilo et al. ..... 210/198.2
6,074,725 A 6/2000 Kennedy
6,080,295 A 6/2000 Parce et al.
6,086,243 A 7/2000 Paul et al. ..... 366/273
6,100,107 A 8/2000 Lei et al.
6,106,685 A 8/2000 McBride et al. ..... 204/600
6,126,723 A 10/2000 Drost et al.
6,129,973 A 10/2000 Martin et al.
6,156,273 A 12/2000 Regnier et al.
6,171,067 B1 1/2001 Parce
6,176,962 B1 1/2001 Soane et al.
6,210,986 B1 4/2001 Arnold et al.
6,224,728 B1 5/2001 Oborny et al. ..... 204/450
6,255,551 B1 7/2001 Shapiro et al. ..... 588/204
6,267,858 B1 7/2001 Parce et al.
6,277,257 B1 8/2001 Paul et al. ..... 204/450
6,287,440 B1 9/2001 Arnold et al. ..... 204/450
6,290,909 B1 9/2001 Paul et al. ..... 422/70
6,320,160 B1 11/2001 Eidsnes et al.
6,344,145 B1 2/2002 Garguilo et al.
6,352,577 B1 3/2002 Martin et al.
6,406,605 B1 6/2002 Moles ..... 204/601
6,409,698 B1 * 6/2002 Robinson et al. ..... 604/19
6,418,968 B1 7/2002 Pezzuto et al.
6,444,150 B1 9/2002 Arnold
6,460,420 B1 10/2002 Paul et al. ..... 73/851.52
6,472,443 B1 10/2002 Shepodd
6,477,410 B1 11/2002 Henley et al. ..... 204/20
6,495,015 B1 12/2002 Schoeniger et al.
6,529,377 B1 * 3/2003 Nelson et al. ..... 361/699
6,689,373 B2 2/2004 Johnson et al.
6,719,535 B2 * 4/2004 Rakestraw et al. ..... 417/50
6,729,352 B2 5/2004 O'Connor et al.
6,755,211 B1 6/2004 O'Connor et al.
6,770,182 B1 8/2004 Griffiths et al.
6,814,859 B2 11/2004 Koehler et al.
2001/0008212 A1 7/2001 Shepodd et al. ..... 204/451
2002/0048425 A1 4/2002 McBride et al.
2002/0056639 A1 5/2002 Lackritz et al.
2002/0059869 A1 5/2002 Martin et al.
2002/0066639 A1 6/2002 Taylor et al.
2002/0070116 A1 6/2002 Ohkawa ..... 204/603
2002/0089807 A1 * 7/2002 Bluvstein et al. ..... 361/302
2002/0125134 A1 9/2002 Santiago et al. ..... 204/450
2002/0166592 A1 11/2002 Liu et al.
2002/0185184 A1 12/2002 O'Connor et al.
2002/0187074 A1 12/2002 O'Connor et al.
2002/0187557 A1 12/2002 Hobbs et al.
2002/0189947 A1 12/2002 Paul et al.
2002/0195344 A1 12/2002 Neyer et al.
2003/0052007 A1 3/2003 Paul et al.
2003/0061687 A1 4/2003 Hansen et al.
2003/0116738 A1 6/2003 O'Connor et al.
2003/0143081 A1 7/2003 Rakestraw et al.
2003/0150792 A1 8/2003 Koehler et al.
2003/0198130 A1 10/2003 Karp et al.
2003/0198576 A1 10/2003 Coyne et al.
2003/0206806 A1 11/2003 Paul et al.
2003/0226754 A1 12/2003 Le Febre et al.
2004/0011648 A1 1/2004 Paul et al.
2004/0074784 A1 4/2004 Anex et al.
2004/0087033 A1 5/2004 Schembri
2004/0101421 A1 5/2004 Kenny et al.
2004/0115731 A1 6/2004 Hansen et al.
2004/0118189 A1 6/2004 Karp et al.
2004/0129568 A1 7/2004 Seul et al.
2004/0163957 A1 8/2004 Neyer et al.
2004/0182709 A1 9/2004 Griffiths et al.
2004/0238052 A1 12/2004 Karp et al.
2004/0241004 A1 12/2004 Goodson et al.
2004/0241006 A1 12/2004 Taboryski et al.
2004/0247450 A1 12/2004 Kutchinski et al.
2005/0247558 A1 11/2005 Anex et al.

FOREIGN PATENT DOCUMENTS

WO WO 99/16162 4/1999
WO WO 2004/027535 A1 4/1999
WO WO 00/04832 3/2000
WO WO 00/55502 A1 9/2000
WO WO 00/79131 A1 12/2000
WO WO 01/25138 4/2001
WO WO 02/068821 A2 9/2002
WO WO 02/086332 A1 10/2002
WO WO 2004/007348 A1 1/2004

OTHER PUBLICATIONS

Ananthakrishnan, V. et al., *A.I. Ch.E. Journal*, 11(6):1063-1072 (Nov. 1965).
Aris, R., *Oxidation of organic sulphides. VI, Proc. Roy. Soc.* (London), 235A:67-77, no date.
Burgreen, D. et al.,*The Journal of Physical Chemistry*, 68(95):1084-1091 (May 1964).
Chatwin, P.C. et al., *J. Fluid Mech*., 120:347-358 (1982), no month.
Doshl, M.R. et al., *Chemical Engineering Science*, 33:795-804 (1978), no month.
Drott, J. et al., *J. Micromech. Microeng*. 7:14-23 (1997), no month.
Gan, W. et al, *Talanta* 51:667-675 (2000), no month.
Jessensky O. et al., *J. Electrochem. Soc*. 145(11):3735-3740 (Nov. 1998).
Johnson, D.L. et al., *Physical Review Letters*, 37(7):3502-3510 (Mar. 1, 1988).
Johnson, D.L. et al., *Physical Review Letter*, 57(20):2564-2567 (Nov. 17, 1986).
Johnson, D.L. et al., *J. Fluid Mech*. 176:379-402 (1987), no month.
Kobatake, Y. et al., *J. Chem. Phys*. 40(8):2212-2218 (Apr. 1964).
Kobatake, Y. et al., *J. Chem. Phys*. 40(8):2219-2222 ( Apr. 1964).
Ma, Y. et al., *Microporous and Mesoporous Materials*, 37:243-252(2000), no month.
Morrison, F.A. et al., *J. Chem. Phys*. 43:2111-2115 (1965), no month.
Nakanishi, K. et al., *Journal of Crystalline Solids*, 139:1-13 (1992), no month.
Paul, P.H. et al., *Micro Total Analysis Systems*, pp. 583-590 (2000), no month.
Paul, P.H. et al., *Micro Total Analysis Systems*, pp. 49-52 (1998).
Peters,. E C. et al., *Anal. Chem*. 69:3646-3649 (1997.

Philipse, A.P., *Journal of Materials Science Letters*, 8: 1371-1373 (1989).
Rastogi, R.P., *J. Scient. Ind. Res*., (28):284-292 (Aug. 1969).
Rice, C.L. et al., *J. Phys. Chem*. 69(11):4017-4024 (Nov. 1965).
Rosen, M.J., *Surfactants and Interfacial Phenomena*, Second Ed., John Wiley & Sons, pp. 32-107.
Schmid, G. J. *Membrane Sci*. 150:159-170 (1998).
Schmid, G. et al., *J. Membrane Sci*. 150:197-209 (1998).
Taylor, G., *Prox. Roy. Soc*. (London) 21:186-203.
Weston, A. et al., *HPLC and CE, Principles and Practice*, pp. 82-85, Academic Press.
Wijnhoven, J. et al., *Science*, 281:802-804 (Aug. 7, 1998).
Yzawa, T., *Key Engineering Materials*, 115: 125-146 (1996).
Uhlig, E. L. P., et al., "The electro-osmotic actuation of implantable insulin micropumps", Journal of Biomedical Materials Research, (1983), pp. 931-943, vol. 17.
Aris, R. On the dispersion of a solute in a fluid flowing through a tube. Proceedings of the Royal Society of London. Series A, Mathematical and Physical Sciences. 1956; 235(1200):67-77.
Baquiran, et al. Lippincott's Cancer Chemotherpy Handbook Second Edition. Lippincott, Philadelphia. 2001.
Becker, et al. Polymer Microfabrication Method for Microfluidic Analytical Application. Electrophoresis. 2000; 21: 12-26.
Belfer, et al. Surface Modification of Commercial Polyamide Reverse Osmosis Membranes. J. Membrane Sci. 1988; 139: 175-181.
Chu, et al. Physicians Cancer Chemotherapy Drug Manual 2002. Jones and Bartlett Publisher. Massachusetts. 2002.
Churchill, et al. Complex Variables and Applications. McGraw-Hill, Inc. New York. 1990.
Conway, B.E. Electrochemical Supercapacitors Scientific Fundamentals and Technological Applications. Kluwer Academic/Plenum Publishers. 1999:12-13, 104-105, 192-195.
Conway, B.E.. Electrochemical Capacitors Their Nature, Function, and Applications. Electrochemistry Encyclopedia. 2003. Available at http://electrochem.cwru.edu/ed/encycl/art-c03-elchem-cap.htm. Accessed May 16, 2006.
Gennaro, A.R. Remington: The Science and Practice of Pharmacy. 20th edition. Lippincott Williams & Wilkins. Philadelphia. 2000.
Gleiter, et al. Nanocrystalline Materials: A Way to Solids with Tunable Electronic Structures and Properties? Acta Mater. 2001; 49:737-745.
Gongora-Rubio, et al. The Utilization of Low Temperature Co-fired Ceramics (LTCC-ML) Technology for Meso-scale EMS, a Simple Theristor Based Flow Sensor. Sensors and Actuators. 1999; 73 (3): 215-221.
Goodman and Gilman's The Pharmacological Basis of Therapeutics. 10th edition. McGraw-Hill Medical Publishing Division. 2001.
Gritsch, et al. Impendance Spectroscopy of Porin and Gramicidin Pores Reconstituted into Supported Lipid Bilayers on Indium-Tin-Oxide Electrodes. Langmuir. 1998; 14: 3118-3125.
Haisma, J. Direct Bonding in patent literature. Philips. J. Res. 1995;49:165-170.
Jackson, J.D. Classical Electrodynamics 2nd Edition. John Wiley & Sons, Inc. New York. 1962.
Jimbo, et al. Surface Characterization of Polyacrylonitrile Membranes: Graft-Polymerized with Ionic Monomers as Revealed by Zeta potential Measurements. Macromolecules. 1998; 31: 1277-1284.
Klein, E. Affinity Membranes: a 10 Year Review. J. Membrane Sci. 2000; 179:1-27.
Kotz, et al. Principles and applications of electrochemical capacitors. Electrochimica Acta. 2000; 45:2483-2498.
Martin, et al. Laminated Plastic Microfluidic Components for Biological and Chemical Systems. J. Vac. Sci. Technol. 1999; 17: 2264-2269.
Mroz, et al. Disposable Reference Electrode. Analyst. 1998; 123:1373-1376.
Roberts, et al. UV Laser Machined Polymer Substrates for the Develpment of Microdiagnostic Systems. Anal. Chem. 1997; 69: 2035-2042.
Skeel, R. Handbook of Cancer Chemotherapy. 6th edition. Lippincott Williams & Wilkins. 2003.
Stokes, V.K. Joining Methods for Plastics and Plastic Composites: An Overview. Poly. Eng. And Sci. 1989; 29:1310-1324.
Takata, et al.. Modification of transport properties of ion exchange membranes XIV. Effect of molecular weight of polyethyleneimine bonded to the surface of cation exchange membranes by acid-amide bonding on electrochemical properties of the membranes. J. Membrance Sci. 2000; 179: 101-107.
Vinson, J. R. Adhesive Bonding for Polymer Composites. Polymer Eng. And Science. 1989; 29:1325-1331.
Watson, et al. Recent Developments in Hot Plate Welding of Thermoplastics. Poly. Eng. And Sci. 1989; 29: 1382-1386.
US 6,406,905, 06/2002, Parce et al. (withdrawn)

* cited by examiner

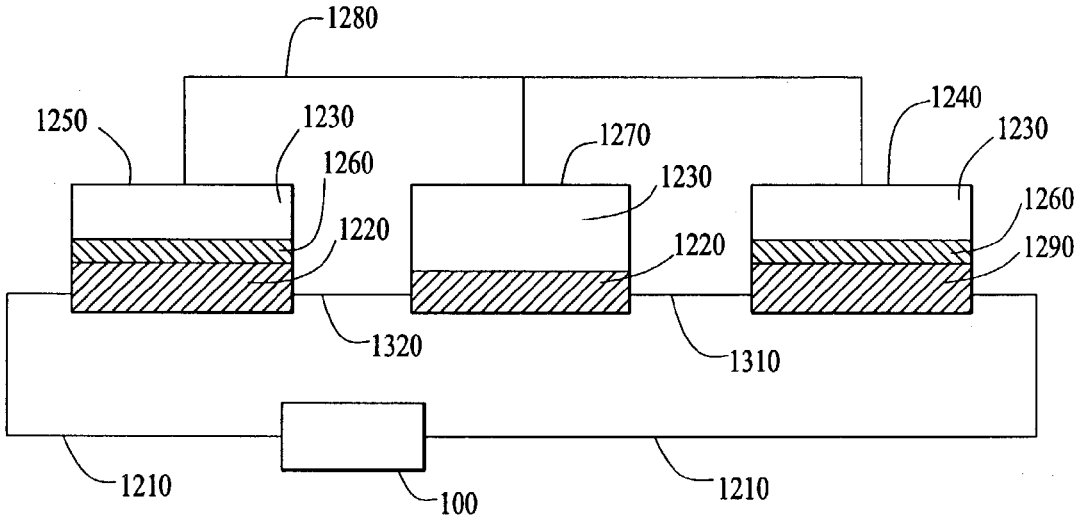
FIG. 9
FIG. 10
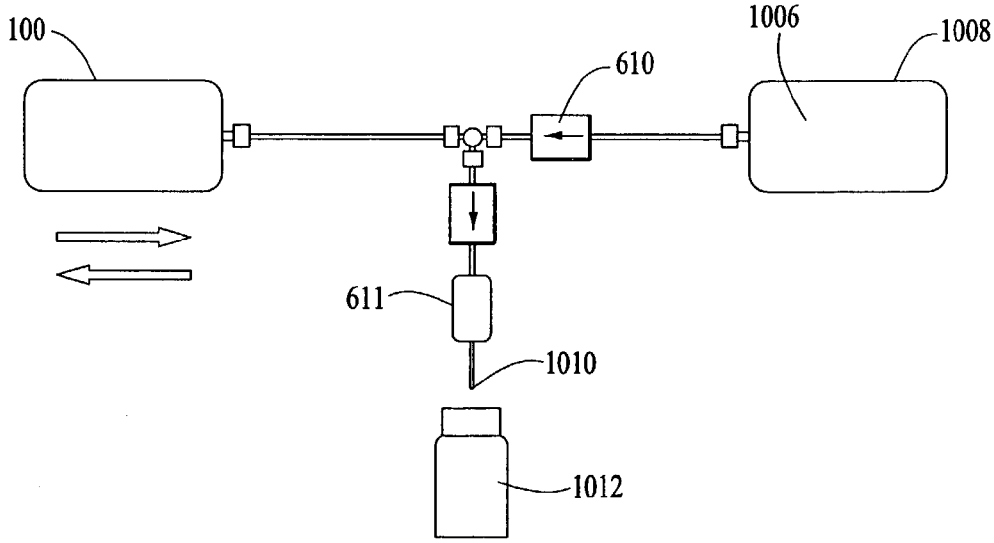

ELECTROKINETIC PUMP HAVING CAPACITIVE ELECTRODES

BACKGROUND

Electrokinetic flow devices in the prior art employ simple wire or wire mesh electrodes immersed in a fluid. In these prior art devices, gas produced by current flowing through the electrodes must be vented and pH evolution must be tolerated. Therefore, the conductivity of the fluid and hence, the flow rate of the fluid, are limited in order to limit the amount of gas produced and the rate of pH evolution. Some prior art ignores the pH evolution. Moreover, since gas is produced and must be vented, these prior art flow devices cannot operate for extended periods of time in a closed system.

Others, such as U.S. Pat. Nos. 3,923,426; 3,544,237; 2,615,940; 2,644,900; 2,644,902; 2,661,430; 3,143,691; and 3,427,978, teach mitigation of irreversible pH evolution by using a low conductivity fluid so as to draw as little current as possible. Hence, these prior art devices are only successful when operating for a limited amount of time or when operating at a low current and, hence, low flow rate, e.g., 0.1 mL/min.

U.S. Pat. No. 3,923,426 teaches periodic switching of the polarity of the electrodes to prolong the life of an electrokinetic flow device.

Accordingly, there is a need in the art for an electrokinetic pump that is capable of extended operation in a closed system without producing significant gaseous by-products and without significant evolution of the fluid in the pump ("pump fluid").

Further, and more specifically, there is a need in the art for a high flow rate (e.g. greater than 1 ml/min) electrokinetic pump, and a low flow rate (e.g. in the range of about 25 nL/min to 100 microliters/min) electrokinetic pump that is capable of extended operation (i.e. multiple days to greater than multiple weeks) in a closed system without producing gaseous by-products and without significant evolution of the fluid in the pump.

SUMMARY

The present invention provides an electrokinetic device capable of achieving high as well as low flow rates in a closed system without significant evolution of the pump fluid.

The electrokinetic device comprises a pair of electrodes capable of having a voltage drop therebetween and a porous dielectric material between the electrodes. The electrodes are made of a capacitive material having a capacitance of at least $10^{-4}$ Farads/cm$^2$ or, more preferably, $10^{-2}$ Farads/cm$^2$.

The electrodes preferably are comprised of carbon paper impregnated with carbon aerogel or comprised of a carbon aerogel foam. The porous dielectric material can be organic (e.g. a polymer membrane) or inorganic (e.g. a sintered ceramic). The entire electrokinetic device can be laminated.

The capacitance of the electrodes is preferably charged prior to the occurrence of Faradaic processes in the pump fluid. A method of using the electrokinetic devices comprises the steps of: applying a positive current to the electrodes, thereby charging the capacitance of the electrodes; and applying a negative current to the electrodes, thereby charging the capacitance to the opposite polarity.

The capacitance of the electrodes can be that associated with the electrochemical double-layer at the electrode-liquid interface.

Alternatively, the electrodes can be made of a pseudocapacitive material having a capacitance of at least $10^{-4}$ Farads/cm$^2$. For example, the pseudocapacitive material can be a substantially solid redox material, such as ruthenium oxide.

There can be a spacer between the porous dielectric material and the electrodes. The spacer can minimize undesirable effects associated with electrode roughness or irregularities. An electrode-support material can sandwich the electrodes and the porous dielectric material, so that when there is a current flux on the electrodes it is uniform. The flow resistance of the spacer, the support material, and electrodes can be less than that of the porous dielectric material.

The embodiments of pumps described thus far may be included in various pump systems described herein.

BRIEF DESCRIPTION OF THE DRAWINGS

These and other features, aspects and advantages of the present invention will become better understood with regard to the following description, appended claims, and accompanying drawings where:

FIG. 9 schematically illustrates a two-phase heat transfer system that employs a direct electrokinetic pump according to the present invention;

FIG. 10 schematically illustrates a system for contactless dispensing utilizing an electrokinetic pump according to the invention.

DESCRIPTION

Definitions

Double-layer capacitance—capacitance associated with charging of the electrical double layer at an electrode—liquid interface.

Pseudocapacitance—capacitance associated with an electrochemical oxidation or reduction in which the electrochemical potential depends on the extent of conversion of the electrochemically active species. It is often associated with surface processes. Examples of systems exhibiting pseudocapacitance include hydrous oxides (e.g. ruthenium oxide), intercalation of Li ions into a host material, conducting polymers and hydrogen underpotential deposition on metals.

Faradaic process—oxidation or reduction of a bulk material having an electrochemical potential that is (ideally) constant with extent of conversion.

Capacitance per area—the capacitance of an electrode material per unit of surface geometric area (i.e. the surface area calculated from the nominal dimensions of the material), having units Farads/$cm^2$. The geometric area is distinguished from the microscopic surface area. For example, a 1 cm by 1 cm square of aerogel-impregnated carbon paper has a geometric area of 1 $cm^2$, but its microscopic area is much higher. For paper 0.25 mm thick the microscopic area is in excess of 1000 cm.

Capacitive electrodes—electrodes made from a material having a double-layer capacitance per area, pseudocapacitance per area, or a combination of the two of at least $10^{-4}$ Farads/$cm^2$ and more preferably, at least $10^{-2}$ Farads/$cm^2$.

Pseudocapacitive electrodes—electrodes made from a material having a capacitance of at least $10^{-4}$ Farads/$cm^2$ resulting primarily from pseudocapacitance.

Structure

The present invention is directed to an electrokinetic device capable of achieving high as well as low flow rates in a closed system without significant evolution of the pump fluid. This invention is directed to electrokinetic pumps having a porous dielectric material between a pair of electrodes that provide for conversion of electronic conduction (external to the pump) to ionic conduction (internal to the pump) at the electrode-fluid interface without significant solvent electrolysis, e.g., hydrolysis in aqueous media, and the resultant generation of gas. The electrodes also work well in non-aqueous systems. For example, pumps embodying the invention can be used to pump a propylene carbonate solvent with an appropriate electrolyte, such as tetra(alkyl) ammonium tetrafluoroborate. Through the controlled release and uptake of ions in the pump fluid, the electrodes are designed to evolve the pump fluid in a controlled fashion.

Figure 1A:
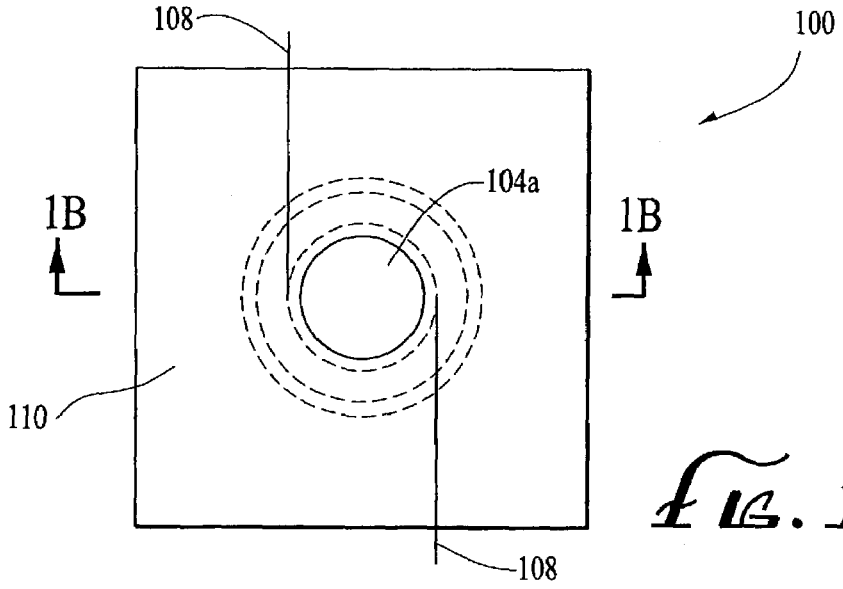
FIG. 1A is a front elevation view of a first embodiment of a high flow rate pump in accordance with the present invention.
Figure 1B:
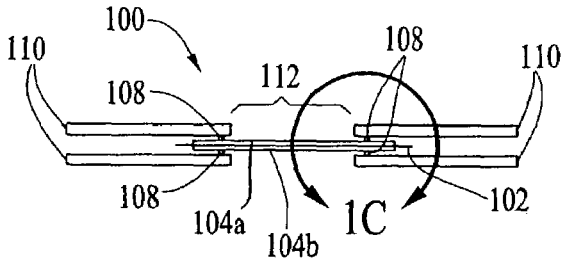
FIG. 1B is a top cross-sectional view of the pump of FIG. 1A.
Figure 1C:
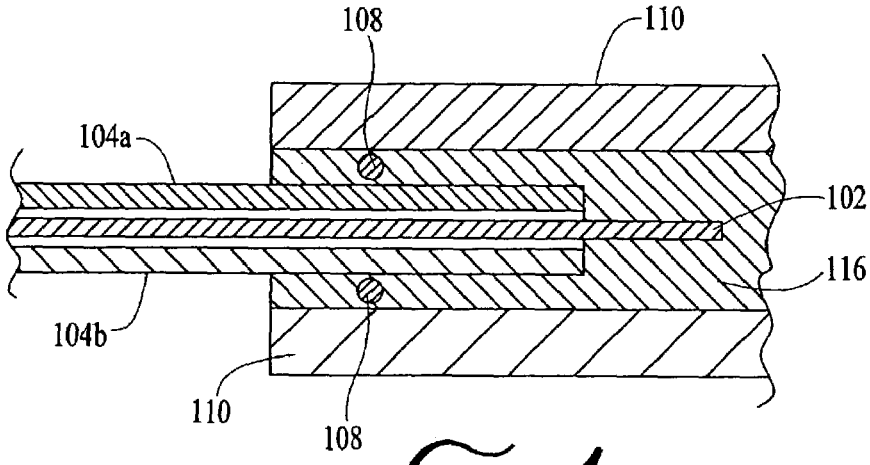
FIG. 1C illustrates enlarged detail view of the pump of FIG. 1A in region 1C identified in FIG. 1B.

With reference to FIGS. 1A, 1B and 1C, a pump 100 according to the present invention has a porous dielectric material 102 sandwiched between two capacitive electrodes 104*a* and 104*b* having a voltage drop therebetween. The electrodes 104*a* and 104*b* preferably directly contact the porous dielectric material 102 so that the voltage drop across the porous dielectric material preferably is at least 10% of the voltage drop between the electrodes, more preferably at least 50% of the voltage drop between the electrodes, and most preferably at least 85% of the voltage drop between the electrodes. This configuration maximizes the potential across the pump material 102 so that a lower total applied voltage is required for a given flow rate. It is advantageous for the pump 100 to have a low drive voltage so that it is suitable for integration into compact systems or for close coupling to sensitive electronic devices. Further, sandwich structures with the electrodes 104*a* and 104*b* in intimate contact with the porous dielectric material 102 prevent the flexure of the porous dielectric material when the pump 100 is configured to pump through the face of the porous dielectric material. Pump flexure reduces the amount of pump fluid pumped in a cycle.

Preferably electrical leads 108 are placed in contact with outside surfaces of the electrodes 104*a* and 104*b*. The porous dielectric material 102, electrodes 104*a* and 104*b* and the leads 108 can be sandwiched between supports 110, each having a hole 112 so that the pump fluid can flow through the porous dielectric material 102 and the electrodes 104*a* and 104*b*. The supports 110 help to maintain the planarity of the pump 100. Maintaining the planarity of the pump 100 helps to maintain a uniform current flux on the electrodes 104*a* and 104*b*.

Figure 2:
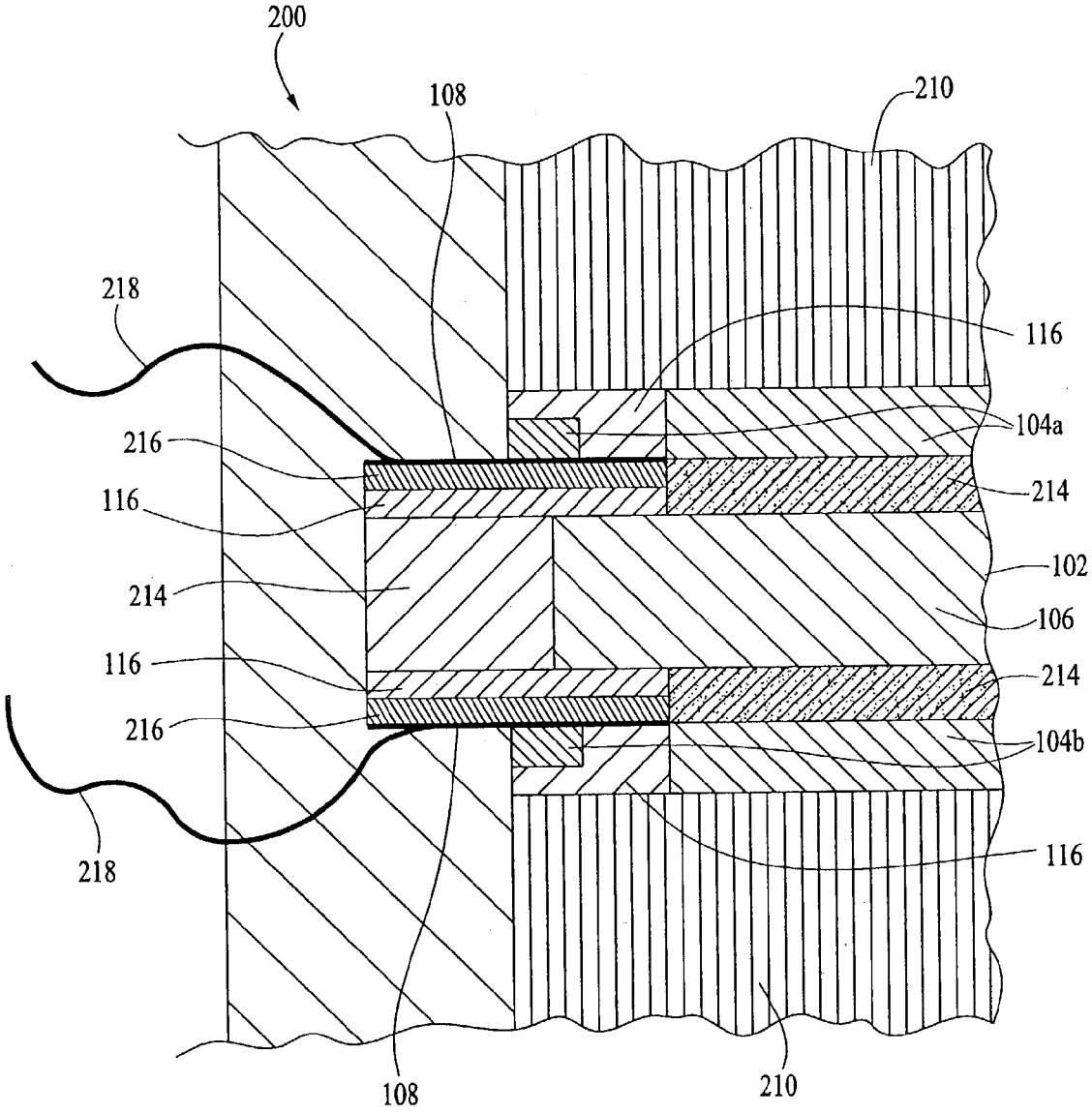
FIG. 2 is a cross-sectional view of a portion of a second embodiment of an electrokinetic pump in accordance with the invention.

The pump 100 is preferably laminated using a bonding material 116 so that the pump and its lamination forms an integrated assembly that may be in the form of a chip-like assembly as described in U.S. patent application entitled Laminated Flow Device invented by Phillip H. Paul, David W. Neyer, and Jason E. Rehm, filed on Jul. 17, 2002, Ser. No. 10/198,223, and incorporated herein by reference. Pump 200 illustrated in FIG. 2 is laminated. Alternatively, the pump 100 can be placed on an etched chip, for example, or incorporated into a flow system by any other means known in the art.

A spacer 214, shown in FIG. 2, can be used to provide a gap between the electrodes 104*a* and 104*b* and the porous dielectric material 102 to aid in smoothing the current flux density at the electrodes and to prevent puncture of the porous dielectric material when the electrodes have sharp edges or points. Use of the spacer 214 is preferable when the electrodes 104*a* and 104*b* have surface irregularities. The electrodes 104*a* and 104*b* in FIG. 2 have lead-out rings 216, which have flying leads 218.

In the preferred embodiment, over 85% of the voltage drop between the electrodes 104*a* and 104*b* appears across the porous dielectric material 102. To this end, it is preferable that the electrical resistances of the spacers 214 are much less than that of the porous dielectric materials 102.

In FIG. 1, supports 110 clamp the periphery of the assembled porous dielectric material 102, electrodes 104*a* and 104*b* and the leads 108. In FIG. 2, further support of the assembled porous dielectric material 102, electrodes 104*a* and 104*b*, leads 108, and spacers 214 can be provided by electrode-supports 210. These electrode-supports 210 can be, for example, rigid porous frits or sections of honeycomb-like material.

In the preferred embodiment, there is minimal pressure loss due to flow through the spacers 214, the electrodes 104*a* and 104*b*, and the electrode-supports 210. To this end, it is preferable that: the flow resistances of the electrode-supports 210 and the electrodes 104*a* and 104*b* are much less than that of the spacers 214, and the flow resistances of the spacers are much less than that of the porous dielectric material 102. This can be accomplished by a careful selection of the pore size of each element.

For example, in FIG. 2 the electrical resistance is proportional to the product of formation factor and thickness divided by the area of each element (here 'thickness' refers to the dimension of a component along the direction of flow, and 'area' refers to the area of the face of an element through which the flow passes). The flow resistance is proportional to the product of formation factor and thickness divided by the product of the area and the square of the pore size for each element.

As a specific example, if the porous dielectric material to has 0.2 micron pores, a formation factor of 3 and a thickness of 1 mm; the spacers have 3 micron pores, a formation factor of 2 and a thickness of 0.1 mm; the electrodes have 20 micron pores, a formation factor of 3 and a thickness of 2 mm; and the supports have 1 mm pores, a formation factor of 1.2 and a thickness of 3 mm, then the voltage drop across the porous dielectric material is then 88% of the total applied voltage and the flow conductances (i.e. the inverse of the flow resistance) of the porous dielectric, the spacer, the electrode and the support are then about 0.02, 63, 94 and 3900 ml per minute per psi per square cm, respectively.

The diameter of the faces of the pumps 100 and 200, which pump fluid can flow through, are each larger than the thicknesses of the respective pumps so that both pumps resemble a coin, with the flow through the face, as opposed to most low-flow-rate and/or high-pressure designs that are more rod-like with the flow along a longitudinal axis. Pumps embodying the invention do not have to have cylindrical symmetry, but can have any shape.

The area of the pumps 100 and 200 through which fluid can flow is selected to meet flow rate requirements. For example: a pump running at about 3V can achieve an open-load flowrate of about 1.2 mL/min per $cm^2$ thus an open-load flowrate of 10 mL/min can be achieved with a pump having an area of about 8.8 $cm^2$. The same flow rate can be achieved by running in parallel multiple pumps having smaller areas.

Figure 3A:
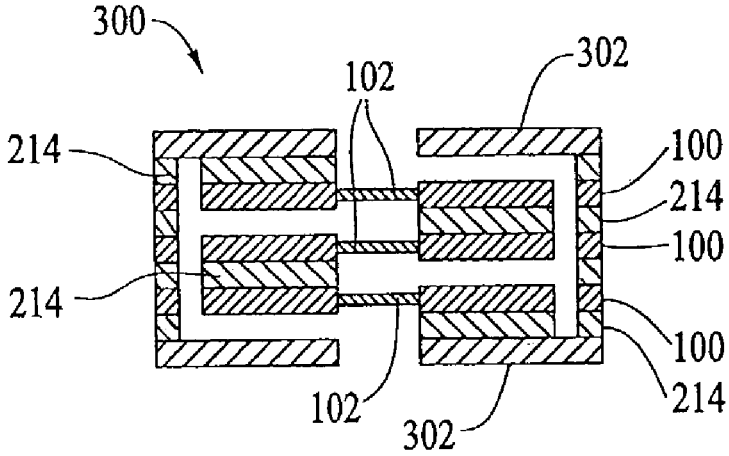
FIG. 3A is a top cross-sectional view of a stack of three electrokinetic pumps of FIG. 1A.
Figure 3B:
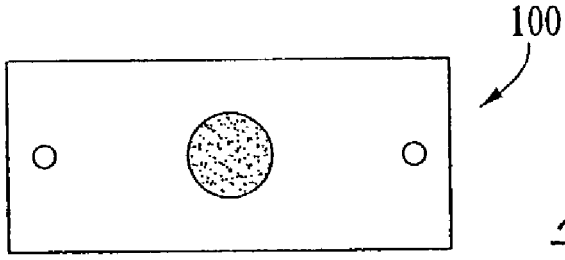
FIG. 3B is a front elevation view of a simple electrokinetic pump in the stack of FIG. 3A.
Figure 3C:
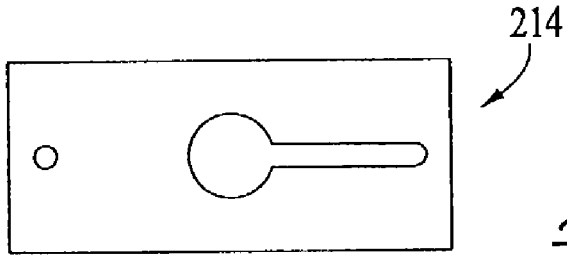
FIG. 3C is a front elevation view of the spacer of FIG. 3A.
Figure 3D:
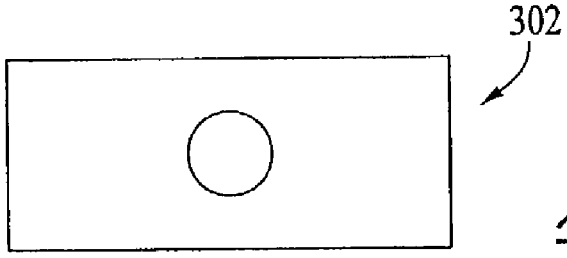
FIG. 3D is a front elevation view of the cap of FIG. 3A.

A compact parallel multiple element pump 300 is shown in FIG. 3A. This multiple element pump 300 comprises a stack of pumps 100 and spacers 214 finished with caps 302. The direction of each pump 100 element, i.e. polarity of the driving voltage, preferably is reversed relative to the adjacent pump so that no voltage drop is applied across the openings created by the spacers 214. Any number of pumps can be combined to form a parallel pump and any size stack can be made out of just three types of elements, caps 302 shown in FIG. 3D, spacers 214 shown in FIG. 3C and pumps 100 shown in FIGS. 3B and 1A-1C. The flow rate of the parallel pump 300 is the sum of the flow rates of each of the pumps 100. Alternatively, the pumps 100 may also be configured in series as described by Rakestraw et al. in U.S. patent application Ser. No. 10/066,528, filed Jan. 31, 2002 and entitled Variable Potential Electrokinetic Devices and incorporated herein by reference and act as a pressure amplifier for higher-pressure operation.

Supports

The supports 110 can be formed of any material known in the art that provides sufficient mechanical strength and dielectric strength, such as: polyetherimide (PEI, known by the brand name Ultem), polyethersulfone (PES, known by the brand name Victrex), polyethylene terephthalate (PET, known by the brand name Dacron).

The electrode-supports 210 can be a 3-mm thick honeycomb having 1 mm cells, 50-micron cell wall thickness, and a 92% open area, i.e., 92% of the total area of the electrode-support is open, for example.

The type, cell size, and thickness of the electrode-supports 210 are preferably selected to provide the mechanical strength to maintain the necessary degree of planarity of the pump. It is preferable that any flow-induced flexure of the electrodes (and similar flexure of the pump medium sandwiched between the electrodes) be limited to some small fraction (preferably less than ten percent) of the displacement of the liquid per one-half cycle. For example: a pump running at 15 mL/min, with an oscillatory cycle time of 8 seconds and an area of about 12 $cm^2$, gives a liquid displacement of about 0.8 mm per one-half cycle. In this example, it is preferable that the electrodes be supported in a fashion to limit any electrode flexure to less than 0.08 mm.

Leads

Preferably, the electrical contacts to the electrodes are formed from a metal, preferably platinum, that is electrochemically stable (i.e. not subject to redox reactions) under the electrochemical conditions encountered within the pump liquid environment. The electrical contacts may be in the form of a wire lead that may also serve as a flying lead, or a foil or as a thin layer deposited on an insulating support. Flying leads that are connected to the electrode contacting leads and do not contact the liquid may be of any type common in electrical components and wiring.

Spacers

The spacer 214 can be formed of any large pore dielectric material, such as acrylic copolymer foam membrane or polypropylene. Preferably the thickness of the spacer 214 is as small as possible but greater than one half of the scale of any irregularities in the electrodes 104*a* and 104*b*, e.g. slightly thicker than one half of the wire diameter for a wire mesh electrode. For example, the spacer can have 5-10 micron pores, a formation factor of 1.7 and a 50 micron thickness.

Electrodes

Preferably 25% and, more preferably 50% of the total area of the electrodes 104*a* and 104*b* is open and the electrodes have a flow through design that covers an entire face of the porous dielectric material 102 and a geometric structure that provides good fluid exchange at all the current carrying surfaces to facilitate the replenishment of the ions at the electrodes. In the flow-through design the electrode geometric area preferably matches the geometric area of the pump medium. For example, in a case where the pump medium has a disc of diameter 13 mm, electrodes with 11 mm diameters have been used. Further, the electrodes 104*a* and 104*b* are preferably free of sharp edges and points so as to support without puncturing the porous dielectric material 102 and to provide a uniform current flux. The electrodes can be in the form of carbon paper, carbon foam, perforated plates, porous frits, porous membranes, or wire mesh, for example.

The electrodes 104*a* and 104*b* preferably are made from a material having a double-layer capacitance of at least $10^{-4}$ Farads/$cm^2$, more preferably, at least $10^{-2}$ Farads/$cm^2$, as these electrodes can function with a wide range of pump fluids, i.e., any fluid having a pH value and an ionic content compatible with the porous dielectric material 104, whereas pseudocapacitive electrodes can function with a limited range of pump fluids as they need to be supplied reactants in order to avoid electrolysis of the pump fluid.

Carbon paper impregnated with carbon aerogel is the most preferable electrode material as it has a substantial double-layer capacitance and is free of sharp edges and points. The high capacitance of this material arises from its large microscopic surface area for a given geometric surface area. At high currents, (e.g. 1 mA per square cm) the double layer capacitance is about 10 mF/cm$^2$ and at low currents, (e.g. 1 microamp per square cm) the double-layer capacitance is about 1 F/cm$^2$.

Many other forms of carbon also have very large microscopic surface areas for a given geometric surface area and hence exhibit high double-layer capacitance. For example, carbon mesh, carbon fiber (e.g., pyrolized poly(acrylonitrile) or cellulose fiber), carbon black and carbon nanotubes all have significant double layer capacitance. Capacitive electrodes can be formed of materials other than carbon, even though carbon is preferred as it is an inert element and therefore reactions are slow when the voltage applied to the electrodes accidentally exceeds the electrolysis threshold. Capacitive electrodes can be formed of any conductor having a high microscopic surface area, such as sintered metal.

When pseudocapacitive electrodes are used, the electrode chemistry is arranged to minimize any irreversible electrochemical reactions that might alter the pump fluid and provide for conversion from electronic conduction to ionic conduction at the electrode-fluid interface, so that gaseous products are not produced and irreversible alteration of the pump fluid or electrode materials are not involved. This is accomplished by limiting the rate of unwanted chemical reactions at the electrodes 104*a* and 104*b* by careful optimization of the combination of: the pump fluid, electrode material, the porous dielectric material 102, physical geometry of the pump, the applied potential, and the current flux density at the electrodes 104*a* and 104*b*.

Examples of possible pseudocapacitive electrode-fluid combinations include:

1. Electrode Material or Coating that Represents a Solid Redox Couple

This can be iridium-, vanadium-, or ruthenium-oxides. These oxides are relatively insoluble in water and many other solvents. Advantage is taken of the multiple oxidation states of the metals but the redox reaction takes place in the solid phase and the charge can be carried as $OH^-$ or $H^+$ ions in the fluid.

2. A Solid Redox Host Material that Dispenses or Inserts a Soluble Ion

This is commonly termed de-intercalation and intercalation, respectively. For example, $Li^+$ ions may be inserted into solids like titanium, molybdenum di-sulfides, certain polymers or carbon. Redox reactions in the solid results in dispensing or uptake of the $Li^+$ ions to or from the fluid. These ions are stable when stored in the solid and solids with intercalated ions are stable when exposed to the transport fluid, although some are reactive with $H_2O$.

Porous Dielectric Materials

Preferably, inorganic porous dielectric materials are used and more preferably, Anopore® membranes, are employed as the porous dielectric pump material 102 in order to provide both a thin pump (e.g. 60 to 2000 microns), and therefore low drive voltage, and narrow pore size distribution, as well as the capability to have both positive and negative zeta potentials. A narrow pore size distribution is desirable as it makes the pump 100 more efficient. Large pores cause the pump 100 to have reduced pressure performance and pores that are too narrow cause increased charge layer overlap, which decreases the flow rate. Anapore® membranes are composed of a high purity alumina that is highly porous, where the pores are in the form of a substantially close-packed hexagonal array with a pore diameter of approximately 200 nm. Alternatively, packed silica beads or organic materials can be used as the porous dielectric material 102. Whatever material is used, the pores preferably have a diameter in the range of 50-500 nm because it is desirable that the pores be as small as possible to achieve high pump stall pressure but still be large enough to avoid substantial double-layer overlap.

Additives to the fluid that provide polyvalent ions having a charge sign opposite to that of the zeta potential of the porous dielectric material are preferably avoided. For example, when the porous dielectric material 102 is comprised of a positive zeta potential material, phosphates, borates and citrates preferably are avoided. For a negative zeta potential material, barium and calcium preferably are avoided.

Use of Electrokinetic Pumps Embodying the Invention

The desired strategy is to apply a current to the electrodes 104*a* and 104*b* to produce a desired flow rate while charging the double-layer capacitance of the electrodes during the first half of the pump cycle. The polarity of the applied field is then changed before Faradaic processes begin, thereby discharging the double-layer capacitance of the electrodes 104*a* and 104*b* and then recharging the electrodes with the opposite polarity causing the pump fluid to flow in the opposite direction during the second half of the pump cycle. This alternation of polarity is referred to here as "AC" operation.

For example, an applied current (I) of 1 mA and a capacitance (C) of 0.3 F results in a voltage rise (dV/dt) of 3.3 mV/sec. At this rate it takes about 5 minutes to increase 1 V. At low enough currents, the time between required polarity changes may be very long and the pump 100 can effectively operate in "DC" mode for some operations.

It is desirable that the electrodes 104*a* and 104*b* supply the current required, even for high flow rates, e.g., greater than 1 mL/min, without significant electrolysis of the pump fluid or significant evolution of the pH of the pump fluid. Avoidance of significant pH evolution of the pump fluid can be accomplished by not allowing the voltage drop between the electrodes 104*a* and 104*b* and the liquid to exceed the threshold for Faradaic electrochemical reactions, which start at approximately 1.2V for water.

The double-layer capacitance or the pseudocapacitance of the electrodes 104*a* and 104*b* preferably is charged prior to the beginning of bulk Faradaic processes. Typical values of double layer capacitance of a plane metal surface (e.g. a drawn metal wire) are 20 to 30 micro Farads/cm$^2$. This value can be substantially increased using methods well-known in the electrochemical arts (e.g. surface roughening, surface etching, platinization of platinum). The double-layer capacitance of the electrodes 104*a* and 104*b* is preferably at least $10^{-4}$ Farads/cm$^2$ and more preferably at least $10^{-2}$ Farads/cm$^2$.

When current flows through pseudocapacitive electrodes, reactants are consumed at the electrodes. When all of the reactants are consumed, gas is produced and the pump fluid may be irreversibly altered. Therefore, preferably the reactants are replenished or current stops flowing through the electrodes before all of the reactants are consumed. The rate that the reactants are supplied to the electrodes 104*a* and 104*b* preferably is high enough to provide for the charge transfer rate required by the applied current. Otherwise, the potential at the electrodes 104*a* and 104*b* will increase until some other electrode reaction occurs that provides for the charge transfer rate required by the current. This reaction may not be reversible.

Thus, when using pseudocapacitive electrodes, the current that can be drawn, hence the electrokinetic flow rate is limited by the transport rate of limiting ionic reactants to or from the electrodes 104*a* and 104*b*. The design of the pump 100 when pseudocapacitive electrodes are used is thus a careful balance between: increasing ionic concentration to support reversible electrode reactions and decreasing ionic concentration to draw less current to prevent irreversible evolution of the pump fluid.

When pseudocapacitive electrodes are used in the pump 100, their electrochemical potential depends on the extent of conversion of the reactants. The dependence of the electrochemical potential on a reaction gives rise to current (I) and voltage (V) characteristics that are nearly described by the equations that characterize the capacitance processes. That is, although the electrodes technically depend on Faradaic processes, they appear to behave as a capacitor.

Figure 4A:
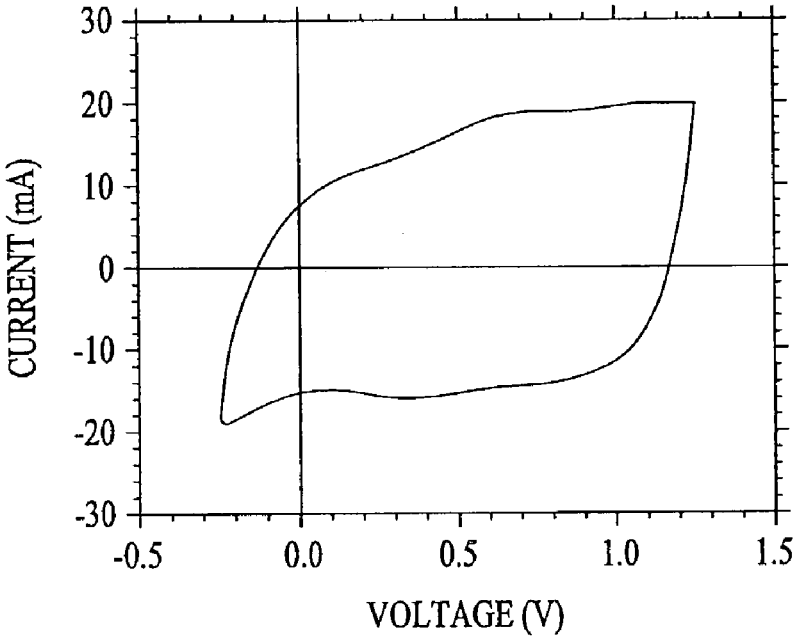
FIG. 4A is a current versus voltage plot for a ruthenium oxide pseudocapacitive electrode that can be used in the pump of FIG. 2.
Figure 4B:
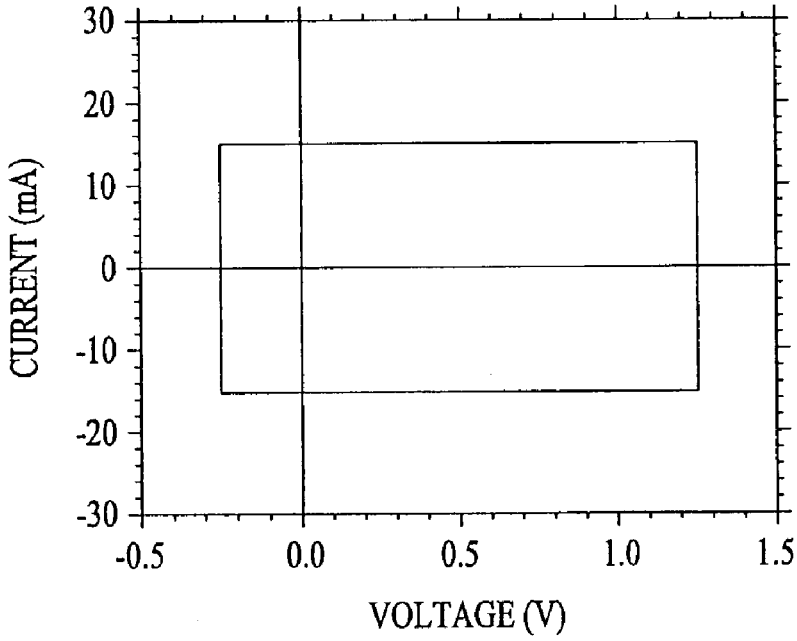
FIG. 4B is a plot of a calculated current versus voltage for a 5 milli Farad capacitor shown for comparative purposes.

An example of the current versus voltage behavior (a cyclic voltammogram) of a ruthenium oxide ($RuO_2$) pseudocapacitive electrode is given in FIG. 4A. The calculated cyclic voltammogram for a 5 mF capacitor is shown for comparison in FIG. 4B. The applied voltage waveform is a triangle wave with an amplitude of 1.5 V peak to peak and a period of 1 second (dV/dt=3 V/sec.) The surface area of the pseudocapacitive electrode was about 0.1 $cm^2$. In contrast, the cyclic voltammogram for an electrode based on bulk Faradaic processes would appear as a nearly vertical line in these plots. The current versus voltage behavior that arises from intercalation of an ion, e.g. $Li^+$, into a host matrix or a conducting polymer electrode is similar to that of a ruthenium oxide electrode.

Pseudocapacitive electrodes, which operate using a surface Faradaic electrochemical process, sacrifice some of the chemical universality of capacitive electrodes, which can be charged by almost any ion. Pseudocapacitance is usually centered on the uptake and release of a specific ion, $H^+$ for $RuO_2$ and $Li^+$ for intercalation, for example. Therefore, pseudocapacitive electrodes are compatible with a smaller number of liquids as $RuO_2$ systems are usually run under acidic conditions and many $Li^+$ intercalation compounds are unstable in water.

In general, electrokinetic pumps embodying the invention can be controlled with either voltage or current programming. The simplest scheme is constant current operation. Under these conditions the electrode-liquid potential ramps linearly in time. The charge transferred on each half of the cycle is preferably balanced. This is to avoid the net charging of the electrodes 104*a* and 104*b*. Equal transfer of charge on each half of the cycle can be accomplished by driving the pump 100 with a symmetric constant-current square wave. Alternatively, if the pump 100 is driven with unequal current on each half of the cycle, then the time of each half of the cycle preferably is adjusted so that the current-time product is equal on both halves of the cycle.

More complex driving schemes are possible. For example, the pump 100 can be driven with a constant voltage for a fixed time period on the first half of the cycle. During the first half of the cycle, the current is integrated to measure the total charge transferred. Then, in the second half of the cycle, the reverse current is integrated. The second half of the cycle preferably continues until the integrated current of the second half equals that of the first half of the cycle. This mode of operation may give more precise delivery of the pump fluid. Even more complex tailored waveforms, controlled current or controlled voltage, are possible. Alternatively, an appropriate voltage waveform can be applied, a voltage step followed by a voltage ramp, for example. A number of other voltage- or current-programmed control strategies are possible.

When the potential is reversed at fixed periods, a constant current power supply can be used to provide power to the electrodes. Methods of providing a constant current are well-known in the electrical arts and include, for example, an operational amplifier current regulator or a JFET current limiter. The power supply can be connected to the flying leads 218 via a timed double-pole/double-throw switch that reverses the potential at fixed intervals. Using a more sophisticated circuit, which adds the ability to vary the regulated current, will provide the capacity to vary the flow rate in response to a control signal.

Alternatively, the potential is reversed when the total charge reaches a fixed limit. A time-integrated signal from a current shunt or a signal from a charge integrator preferably is employed to monitor the charge supplied to the pump 100. Once the charge reaches a preset level, the polarity is reversed and integrated signal from the current shunt or charge integrator is reset. Then the process is repeated.

Using either type of power supply configuration, the pump flow rate and pressure can be modulated by varying the electrical input. The electrical input can be varied manually or by a feedback loop. It may be desirable to vary the flow rate and/or the pressure, for example: to vary a heat transfer rate or stabilize a temperature in response to a measured temperature or heat flux; to provide a given flow rate or stabilize a flow rate in response to the signal from a flowmeter; to provide a given pressure or stabilize a pressure in response to a signal from a pressure gauge; to provide a given actuator displacement or stabilize an actuator in response to a signal from displacement transducer, velocity meter, or accelerometer.

Any of the embodiments of the high flow rate electrokinetic pump can be stacked, arranged in several different configurations and used in conjunction with one or more check valves to fit a specific application. The examples given here list some of the different types of pumps, pump configurations, check valve configurations and types of heat transfer cycles.

Types of Pumps:

Single Element Pump

Single element pumps are illustrated in FIGS. 1A-1C and 2. Single element pumps have a single porous dielectric material 102. FIG. 3 illustrates a set of single element pumps arranged in a parallel array.

Dual Element Pump

Figure 5:
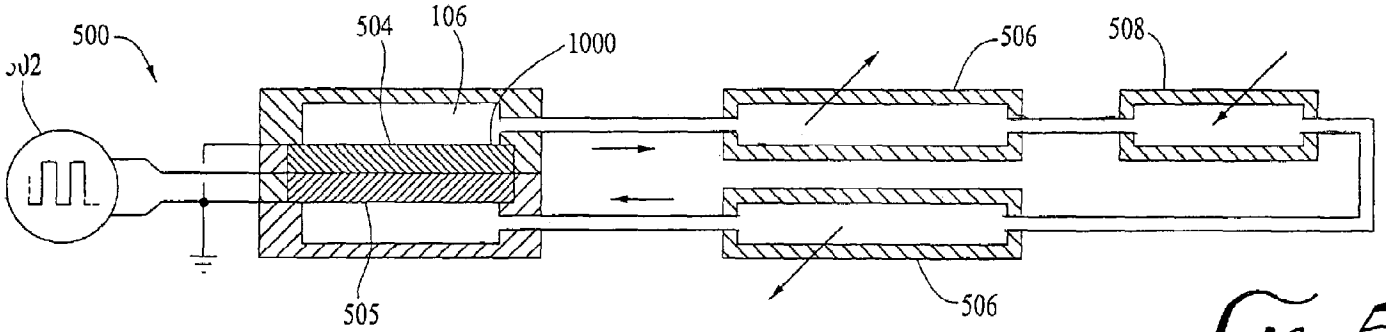
FIG. 5 schematically illustrates a single fluid reciprocating electrokinetic pump driven heat transfer system utilizing an electrokinetic pump according to the present invention.
Figure 6:
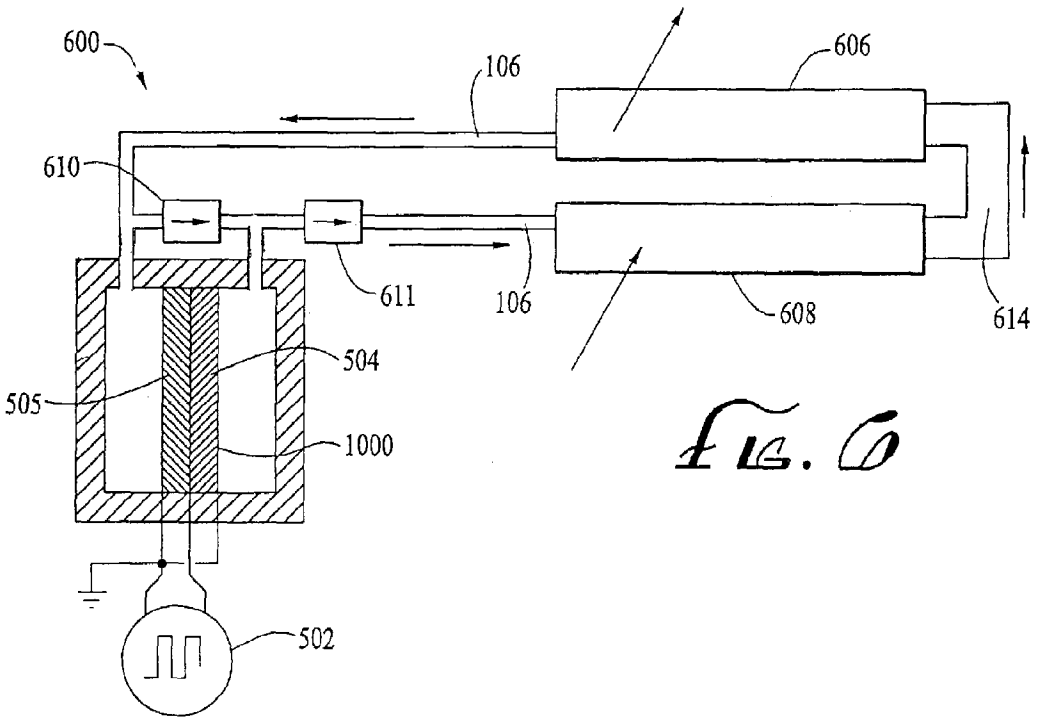
FIG. 6 schematically illustrates a single fluid reciprocating electrokinetic pump driven two phase heat transfer loop using tandem check valves utilizing an electrokinetic pump according to the present invention.
Figure 12:
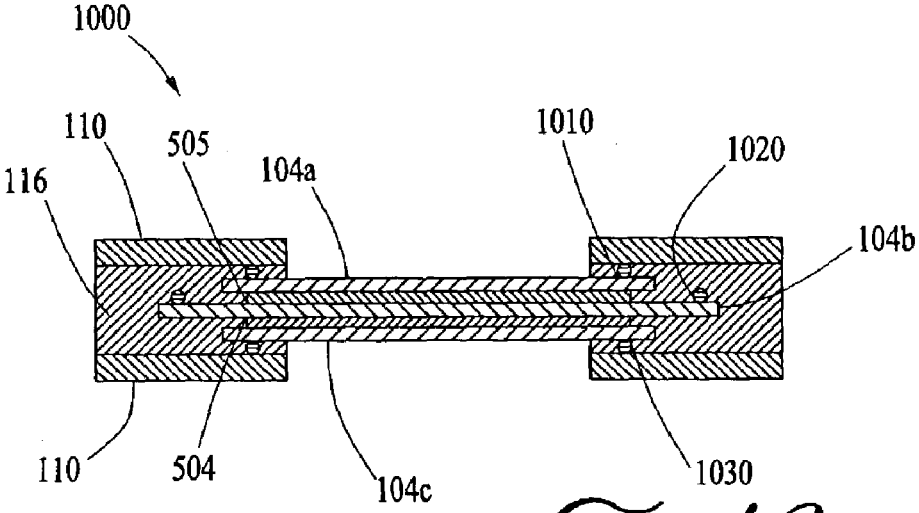
FIG. 12 is a cross-sectional view of a dual element electrokinetic pump in accordance with the present invention.

Dual element pumps 1000, illustrated in FIGS. 5 and 6 and shown in detail in FIG. 12, contain a porous dielectric material 504 having a positive zeta potential and a porous dielectric material 505 having a negative zeta potential. Three electrodes are used in the dual element pumps. Electrode 104*b* is located between the two porous dielectric materials 504 and 505 adjacent to the inside face of each porous dielectric material and electrodes 104*a* and 104*c* are located on or adjacent to the outside face of each of the porous dielectric materials. Electrodes 104*a*, 104*b* and 104*c* are connected to an external power supply (not shown) via leads 1010, 1020 and 1030, respectively. In this embodiment, the electrodes 104*a* and 104*c* preferably are held at ground and the driving voltage from power supply 502 is applied to the center electrode 104*b*.

It is also possible to have multi-element pumps having a plurality of sheets of porous dielectric materials and a plurality of electrodes, one electrode being located between every two adjacent sheets. The value of the zeta potential of each sheet of porous dielectric material has a sign opposite to that of any adjacent sheet of porous dielectric material.

Pump Configurations:

Direct Pump

The porous dielectric material in a direct pump pumps the fluid in the flow path directly. For example, see FIGS. 5 and 6.

Indirect Pump

Figure 7:
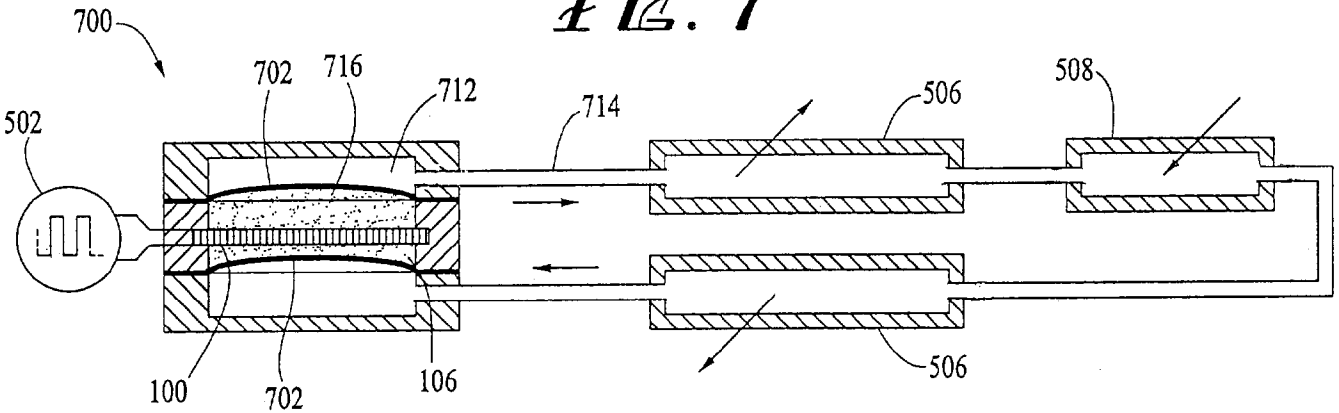
FIG. 7 schematically illustrates a reciprocating electrokinetic pump driven heat transfer system utilizing an electrokinetic pump having two flexible diaphrams according to the present invention.
Figure 8:
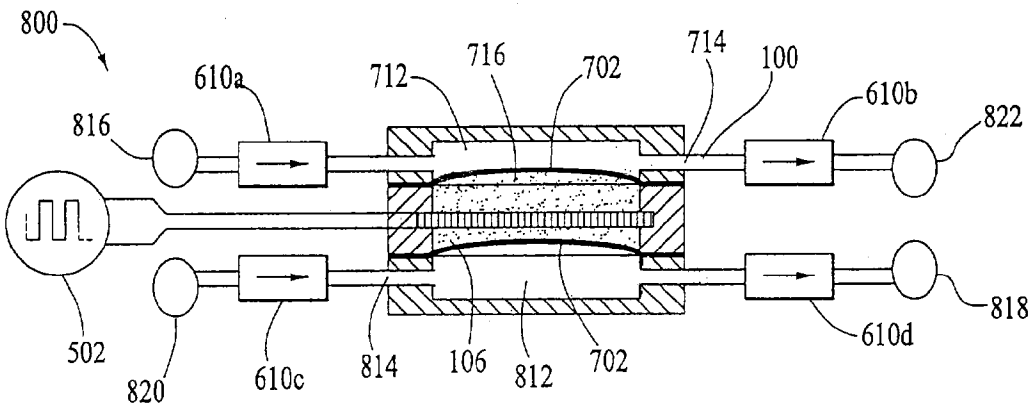
FIG. 8 schematically illustrates an electrokinetic device having a reciprocating electrokinetic pump and four check valves according to the present invention.

Indirect pumps, such as those illustrated in FIGS. 7 and 8, have a flexible impermeable barrier 702, such as a membrane or bellows, physically separating the fluid 106 in the pump 100 and a first flow path 716 from a fluid 712 in a second, external fluid path 714. When the fluid in the pump and the first flow path is pumped, the fluid 106 causes the flexible barrier 702 to flex and pump the fluid 712 in the external fluid path 714.

Check Valve Configurations:

No Check Valves

In some cases no flow limiting devices, e.g., check valves, are needed. In these instances the pump operates in its natural oscillating mode. See, for example, FIGS. 5 and 7.

Two Check Valves

Configurations with two check valves give unidirectional flow, but only pump fluid on one half of the pump cycle, there is no flow on the other half, see for example, FIG. 6.

Four Check Valves

Configurations with four check valves give unidirectional flow and utilize the pump on both halves of the pump cycle, see, for example, FIG. 8. In FIG. 8, there are two separate flow paths 714 and 814 external to the pump 100. In the first half of the pump cycle the first external fluid 712 is pumped through fluid inlet 816 and the check valve 610*a* of the first external flow path 714, while the second external fluid 812 is pumped through check valve 610*d* and out of fluid outlet 818 of the second external flow path 814. In the next half of the pump cycle, the second external fluid 812 is pumped through fluid inlet 820 and check valve 610*c* of the second external flow path 814, while the first external fluid is pumped though the check valve 610*b* and out of fluid outlet 822 of the first external flow path 714. The external fluids 712 and 714 may be the same or different fluids. The external flow paths 714 and 814 can be combined before the check valves 610*a* and 610*c* or after the check valves 610*b* and 610*d* or both.

Types of Heat Transfer Cycles

Single-Phase

Single-phase heat exchangers circulate liquid to carry heat away. See FIGS. 5 and 7. More specifically, FIG. 5, illustrates a single fluid reciprocating electrokinetic pump driven heat transfer system 500. When a positive voltage is applied to the center electrode, the pump 1000 pumps fluid counterclockwise through the system 500 and when a negative voltage is applied to the center electrode, fluid flows clockwise through the system. (Alternatively, if the zeta potentials of the porous dielectric materials were of the opposite sign, the liquid would flow in the opposite direction.) Fluid absorbs heat in the primary heat exchanger 508 and radiates heat in the secondary heat exchangers 506.

Two-Phase

Two-phase heat exchangers rely on a phase change such as evaporation to remove heat. When a direct pump is used in a two-phase heat exchange system, the entire system is preferably configured to recycle the concentrated electrolyte deposited during the evaporation process. This can be done, for example, by using a volatile ionic species, e.g. acetic acid in water. Use of an indirect pump separates the pump liquid, which generally contains added ions, from the heat-transfer liquid.

FIG. 6 illustrates an electrokinetic pump driven two-phase heat transfer loop 600 using a direct pump and tandem check valves 610 and 611. When a negative voltage is applied to the second electrode 104*b* of the pump 1000 the junction of the two check valves is pressurized, the first check valve 610 is closed and the second check valve is opened, and liquid flows towards the evaporator 608. The evaporator 608 absorbs heat and changes the liquid 106 into vapor 614. The vapor 614 travels to the condenser 606 where heat is removed and vapor 614 is transformed back to liquid 106. When a positive voltage is applied to the middle electrode 104*b*, check valve 611 is closed preventing liquid flow in the evaporator/condenser loop and check valve 610 is opened allowing flow around the pump 1000. The second half of the pump cycle, when a positive voltage is applied to the second electrode 104*b*, can be used for electrode regeneration if the charge per half-cycle is balanced.

FIG. 9 shows a two-phase heat transfer system that employs direct pumping. Heat is transferred to liquid 1220 in the evaporator 1270. The addition of heat converts some portion of the liquid 1220 into a vapor 1230 that convects through vapor transfer lines 1280 to condensers 1240 and 1250. Heat is removed from condensers 1250 and 1240 and the resulting drop in temperature results in condensation of vapor 1230. This condensate returns by capillary action through wicks 1260 to the liquid 1220 in the condensers.

Pump 100 operates in an AC mode. During the first half-cycle the pump 100 pushes liquid 1220 from liquid transfer line 1210 to the condenser 1240 and through the liquid transfer line 1310 to evaporator 1270 and also draws liquid (and possibly some vapor) from evaporator 1270 through transfer line 1320 to condenser 1250. On the second half cycle this process is reversed.

The condenser wicks 1260 are made of a porous material that is selected to provide a substantially high resistance to pressure driven liquid flow relative to that of liquid transfer lines 1320 and 1310. Thus the primary result of operation of the pump is displacement of liquid through the transfer lines 1310 and 1320.

The amount of liquid displaced by the pump per half-cycle preferably is greater than the amount of evaporator liquid 1220 vaporized per pump half-cycle. In this manner some liquid is continuously present in the evaporator. Further, the amount of liquid displaced by the pump per half-cycle preferably is sufficient so that fresh liquid from a condenser fully refills the evaporator and so that remaining liquid in the evaporator is fully discharged into a condenser. That is the amount of liquid dispensed per pump half-cycle should exceed the volume of liquid within transfer lines 1310 and 1320 plus the volume of liquid evaporated per half-cycle plus the amount of liquid remaining in the evaporator per half-cycle. In this manner any concentrate, which can result from concentration of any electrolyte as a consequence of distillation of liquid in the evaporator, will be transported by liquid convection and re-diluted in the condensers.

It is preferable to operate this system of evaporator and condensers at the vapor pressure of the operating liquid. Thus the entire system is preferably vacuum leak tight. Prior to operation, the system pressure is reduced to the vapor pressure of the liquid by a vacuum pump or other means known in the arts and then sealed using a seal-off valve or other means known in the arts.

The source of heat input to any of the heat transfer systems disclosed could be, for example, an electronic circuit, such as a computer CPU or a microwave amplifier, that can be directly mounted on or integrated to the evaporators or primary heat exchangers. The removal of heat from the condensers or secondary heat exchangers can be via a passively or actively cooled fin or by any other means known in the arts of heat transfer.

Any combination of pump type, pump configuration, check valve configuration and type of heat transfer cycle can be used with a pump utilizing capacitive, Faradaic or pseudocapacitive electrodes. Other specific applications of electrokinetic pumps embodying the invention aside from heat transfer include, but are not limited to, drug delivery, glucose monitors, fuel cells, actuators, and liquid dispensers.

A high flow rate electrokinetic pump having features of the present invention can be used in liquid dispensing applications that require precise delivery of a given volume of fluid. Often, the application requires contactless dispensing. That is, the volume of fluid is ejected from a dispenser into a receptacle without the nozzle of the dispenser touching fluid in the receptacle vessel. In which case, the configuration of an electrokinetic pump having two check valves, shown in FIG. 10, may be used.

Upon charging the electrodes, the pump 100 withdraws fluid 1006 from a reservoir 1008. The fluid 1006 then passes through a first check valve 610. Upon discharging and recharging the electrodes with the opposite charge, the pump 100 then reverses direction and pushes fluid through the second check valve 611 and out of the nozzle 1010 into a receiving vessel 1012. Precise programmable contactless fluid dispensing across the 10-80 μL range using 0.5 to 2 sec dispense times has been demonstrated.

This embodiment can be a stand-alone component of a dispensing system or can be configured to fit in the bottom of a chemical reagent container. In the later case, the conduits of the electrokinetic pump can be comprised of channels in a plastic plate. The nozzle 1010 can be directly mounted on the plate, and low-profile (e.g. "umbrella" type) check valves can be utilized.

In contactless dispensing applications, the electrokinetic pump must produce sufficient liquid velocity, hence sufficient pressure, at the nozzle tip to eject a well-defined stream from the nozzle. There are other dispensing applications where contactless operation is not needed. Electrokinetic pumps embodying the present invention can be used in these applications as well.

Low-flow-rate pumps in accordance with the present invention can be used in a glucose monitor that delivers 100 nL/min. At this flow rate, electrodes having an area of approximately 1.4 $cm^2$ can run for approximately 7 days before the direction of the current must be changed.

Figure 11A:
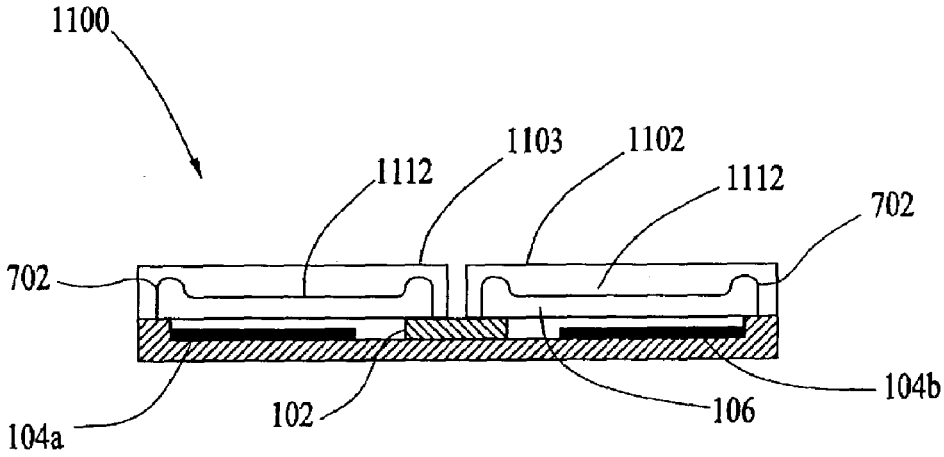
FIG. 11A is a side plan view of a glucose monitor that uses an electrokinetic pump in accordance with the present invention.
Figure 11B:
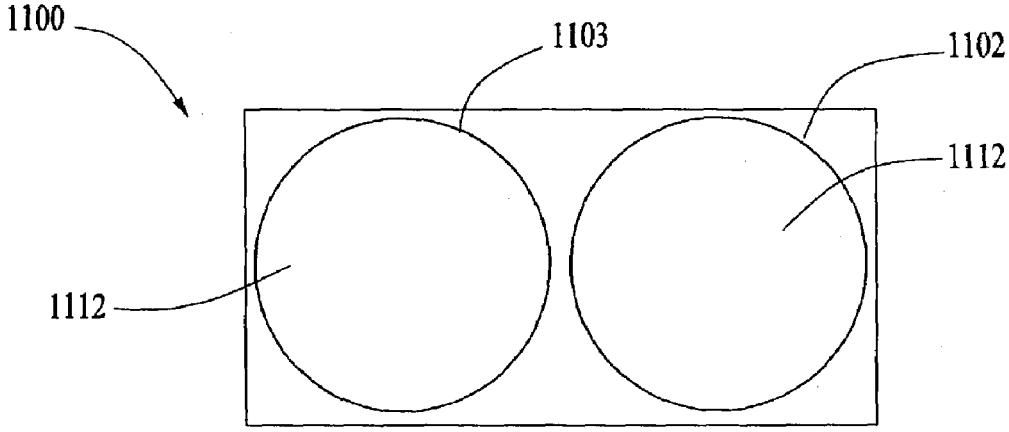
FIG. 11B is a top plan view of the glucose monitor in FIG. 11A.

A design for a low-flow-rate pump that could be used as a glucose monitor pump 1100 is shown in FIGS. 11A and 11B. The pump system pumps fluid indirectly. The pump system has a first reservoir 1102 above a flexible barrier 702. The first reservoir is external to the pump and is filled with the liquid to be delivered (Ringer's solution, for example) 1112. All of the pump fluid 106 remains below the flexible barriers 702. As the pump operates, the pump fluid 106 is pushed through the pump, which extends the flexible barrier 702 and dispenses the liquid 1112. The liquid 1112 circulates through an external loop (not shown), which may contain, for example, a subcutaneous sampling membrane and a glucose sensor, then flows to a second reservoir 1103 external to the pump. This "push-pull" operation of the pump is useful for the glucose sensor (not shown), since it is preferable to keep the sensor at ambient pressure. The design in FIG. 11 may be "folded" such that the reservoirs 1102 and 1103 are stacked to change the footprint of the pump system 1100. The fact that the electrodes 102 do not generate gas and do not alter the pH simplifies the design considerably. It eliminates the need to vent-to-ambient gases produced by electrolysis and eliminates the need to provide a means of controlling the pH of the fluid reservoir (e.g. ion exchange resin in the pump liquid reservoirs).

Advantages of electrokinetic pumps embodying the invention include: gas-free operation, the ability to draw very high current densities (in excess of 20 $mA/cm^2$)and the ability to cycle many times (in excess of 10 million cycles with no apparent change in operating characteristics). Electrokinetic pumps embodying the invention and using capacitive electrodes have the additional advantage of compatibility with a nearly unlimited number of chemical systems.

EXAMPLES

Example 1

The pump 100 illustrated in FIGS. 1A-1C, having a porous dielectric material of a 25-mm diameter Anopore® membrane and 19-mm diameter electrodes in the form of carbon paper impregnated with carbon aerogel, has been used to pump a 1 millimolar sodium acetate buffer having a pH of about 5 at flow rates up to 10 mL/min, about 170 microliters/second, at a driving current of 40 mA.

Example 2

The pump illustrated in FIGS. 1A-1C, having a porous dielectric material of a 13-mm diameter Durapore-Z® membrane, and 11 mm diameter electrodes in the form of carbon paper impregnated with carbon aerogel, and an 8-mm aperture in the PEI, was driven with a +/−0.5 mA square wave with a 10 second period. The pump delivered 0.5 mM lithium chloride at 0.8 microliters/second. It was operated for a total of 35 hours without degradation.

Example 3

The carbon aerogel/Durapore® membrane sandwiched pump was operated in two additional manners. In the second manner of operation, an asymmetric driving current was used to achieve pulsed operation. 0.2 mA was applied for 9.5 seconds and then −3.8 mA was applied for 0.5 seconds. For the first part of the cycle, fluid was drawn slowly backward through the pump. In the second part of the cycle, fluid was pushed forward, delivering 3 microliters. This is the type of action that can be used for dispensing a liquid.

Example 4

In a third manner of operation, energy stored in the capacitance of the electrode was used to drive the pump. One volt was applied to the electrodes using an external power supply to charge the double-layer capacitance. The power supply was then disconnected. When the external leads were shorted together, fluid flowed in the pump, converting electrical energy stored in the electrodes into fluid flow. If the current had been controlled in an external circuit, the flow rate of the pump could have been programmed, thereby creating a "self-powered" electrokinetic metering pump. The potential applications of such a device include drug delivery.

The process of charging the pump electrodes, either in the case of the self-powered electrokinetic pump or in the normal charge-discharge cycle of the AC mode, has been described above as being done by means of running the pump in reverse. Another path not through the pump can be provided to charge the electrodes with ions. This involves a high conductivity ionic path and a charging electrode for each pump electrode.

Example 5

The pump illustrated in FIGS. 1A-1C separately pumped 0.5 mM of lithium chloride, 34 mM acetic acid, and about 34 mM carbonic acid. The pump had carbon mesh electrodes and an organic amine-derivatized membrane as the porous dielectric material.

Although the emphasis here is on pumps and systems built from discrete components, many of the components presented here apply equally to integrated and/or microfabricated structures.

Although the present invention has been described in considerable detail with reference to preferred versions thereof, other versions are possible. For example: an electrokinetic pump having features of the present invention can include three or more porous dielectric pump elements. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" for "step" clause as specified in 35 U.S.C. § 112.

The invention claimed is:

1. In an electrokinetic device, configured to move fluid flow, comprising a pair of electrodes capable of having a voltage drop therebetween, a porous dielectric material between the electrodes, and a conduit in fluid communication with the porous dielectric material, the improvement comprising the electrodes, wherein the electrodes are comprised of a material having a capacitance of at least $10^{-4}$ Farads per square centimeter.

2. The device of claim 1, wherein the capacitance is at least $10^{-2}$ Farads per square centimeter.

3. The device of claim 1 wherein the electrodes are comprised of carbon.

4. In an electrokinetic device, configured to move fluid flow, comprising a pair of electrodes capable of having a voltage drop therebetween, a porous dielectric material between the electrodes, and a conduit in fluid communication with the porous dielectric material, the improvement comprising the electrodes, wherein the electrodes are comprised of a material having a capacitance of at least $10^{-4}$ Farads per square centimeter and the electrodes are comprised of carbon paper impregnated with carbon aerogel.

5. The device of claim 1 wherein the electrodes are comprised of ruthenium oxide.

6. The device of claim 1 wherein the electrodes are comprised of a substantially solid redox couple.

7. The device of claim 1 wherein the electrodes are comprised of substantially solid redox material.

8. The device of claim 1 wherein the capacitance is charged prior to the occurrence of Faradaic processes in a fluid.

9. The device of claim 1 wherein the device is capable of generating a fluid flow at a rate of at least 1 ml/min.

10. In an electrokinetic device, configured to move fluid flow, comprising a pair of electrodes capable of having a voltage drop therebetween, and a porous dielectric material between the electrodes, and a conduit in fluid communication with the porous dielectric material, the improvement comprising the electrodes, wherein the electrodes are comprised of a material having a capacitance of at least $10^{-4}$ Farads per square centimeter and the electrokinetic device is laminated.

11. In an electrokinetic device, configured to move fluid flow, comprising a pair of electrodes capable of having a voltage drop therebetween, and a porous dielectric material between the electrodes, and a conduit in fluid communication with the porous dielectric material, the improvement comprising the electrodes having supports sandwiching the electrodes and the porous dielectric material so that when there is a current flux on the electrodes the current flux is substantially uniform, wherein the electrodes are comprised of a material having a capacitance of at least $10^{-4}$ Farads per square centimeter.

12. The device of claim 11 wherein the supports and the porous dielectric material each have a flow resistance, the flow resistance of the support material being less than that of the porous dielectric material.

13. An electrokinetic pump system comprising:

a. a first flow path;

b. a second flow path, the second flow path being spaced apart from the first c. flow path; and, d. an electrokinetic pump comprising:

i. a first diaphragm in contact with the first flow path, the first diaphragm being flexible and impermeable;

ii. a second diaphragm in contact with the second flow path, the second diaphragm being flexible, impermeable, and spaced-apart from the first diaphragm;

iii. a pair of spaced apart electrodes having a capacitance of at least $10^{-4}$ Farads/cm$^2$ and being located between the diaphragms; and, iv. (iv) a porous dielectric material located between the electrodes.

14. The system of claim 13 wherein the first flow path further comprises a first fluid inlet and a first fluid outlet and wherein the second flow path further comprises a second fluid inlet and a second fluid outlet, wherein the first diaphragm is in contact with the first flow path between the first inlet and the first outlet and the second diaphragm is in contact with the second flow path between the second inlet and the second outlet, further comprising:

a. a first flow limiting device between the first inlet and the first diaphragm;

b. a second flow limiting device between the first diaphragm and the first outlet;

c. a third flow limiting device between the second inlet and the second diaphragm; and, d. a fourth flow limiting device between the diaphragm and the second outlet;

wherein fluid can flow in to the flow paths only through the inlets and fluid can flow out of the flow paths only through the outlets.

15. An electrokinetic device, configured to move fluid flow, comprising:

a. a first porous dielectric material having a positive zeta potential, an inside face and an outside face;

b. a second porous dielectric material having a negative zeta potential, an inside face and an outside face;

c. a conduit in fluid communication with the first porous dielectric material or the second porous dielectric material;

d. a first electrode located between the first and second porous dielectric materials adjacent to the inside face of each of the porous dielectric materials;

e. a second electrode located adjacent to the outside face of the first porous dielectric material; and, f. a third electrode located adjacent to the outside face of the second porous dielectric material;

wherein the electrodes have a capacitance of at least $10^{-4}$ Farads/cm$^2$.

16. An electrokinetic device, configured to move fluid flow, comprising:

a. a plurality of sheets of porous dielectric material;

b. a plurality of electrodes, one electrode being located between every two adjacent sheets of porous dielectric material; wherein each sheet of porous dielectric material has a zeta potential having a value wherein the value has a sign opposite the sign of the value of the zeta potential of an adjacent sheet of porous dielectric material; and, c. a conduit in fluid communication with the plurality of sheets of porous dielectric material, wherein the electrodes have a capacitance of at least $10^{-4}$ Farads/cm$^2$.

17. An electrokinetic pump system comprising:

a. a chamber;

b. an electrokinetic pump in the chamber, the electrokinetic pump comprising first and second electrodes and a porous dielectric material there between, the porous dielectric material dividing the chamber into first and second sections;

c. first and second fluid inlet conduits into the first and second sections, respectively;

d. a first and second fluid outlet conduits from the first and second sections respectively; and, e. a flow limiting device in each conduit so fluid can flow into the pump only through the fluid inlet conduits and out of the pump only through the fluid outlet conduits, wherein the electrodes have a capacitance of at least $10^{-4}$ Farads/cm$^2$.

18. An electrokinetic pump system comprising:

a. an electrokinetic pump comprising:

i. a pair of electrodes having a capacitance of at least $10^{-4}$ Farads/cm$^2$; and, ii. a porous dielectric medium between the electrodes;

b. a conduit; and, c. a flexible barrier between the pump and the conduit.

19. A heat transfer system comprising:

a. an electrokinetic pump comprising:

1. a pair of spaced apart electrodes having a capacitance of at least $10^{-4}$ Farads/cm$^2$ and, ii. a porous dielectric material between the electrodes;

b. a first and a second heat radiator;

c. a heat absorber between the heat radiators; and, d. a conduit running between the electrokinetic pump and the first heat radiator, between the first heat radiator and the heat absorber, between the heat absorber and the second heat radiator, and between the second heat radiator and the electrokinetic pump.

20. A heat transfer system comprising;

a. an electrokinetic pump comprising;

i. a pair of spaced apart electrodes having a capacitance of at least $10^{-4}$ Farads/cm$^2$; and, ii. a porous dielectric material between the electrodes;

b. an evaporator;

c. a condensor;

d. a conduit from the electrokinetic pump to the evaporator, from the evaporator to the condenser, and from the condenser to the electrokinetic pump; and, e. a flow limiting device located between the electrokinetic pump and the evaporator so that no fluid can flow from the evaporator to the electrokinetic pump.

21. A heat transfer system comprising:

a. an electrokinetic pump comprising:

i. a pair of spaced apart electrodes having a capacitance of at least $10^{-4}$ Farads/cm$^2$; and, ii. a porous dielectric material between the electrodes;

b. a first and a second condenser;

c. an evaporator between the condensers; and, d. conduit running between the electrokinetic pump and the first condenser, between the first condenser and the evaporator, between the evaporator and the second condenser, and between the second condenser and the electrokinetic pump.

22. A dispenser comprising:

a. an electrokinetic pump comprising:

i. a pair of spaced apart electrodes having a capacitance of at least $10^{-4}$ Farads/cm$^2$, and, ii. a porous dielectric material between the electrodes;

b. a reservoir in fluid communication with the pump;

c. a receiving vessel in fluid communication with the reservoir and the pump;

d. a first flow limiting device preventing fluid flow from the pump to the reservoir; and, e. a second flow limiting device preventing fluid flow from the receiving vessel to the pump;

f. wherein upon charging the electrodes fluid flows form the reservoir toward the pump and upon discharging the electrodes the fluid flows from the pump into the receiving vessel.

23. In an electrokinetic device, configured to move fluid flow, comprising a pair of electrodes capable of having a voltage drop therebetween, a porous dielectric material between the electrodes, and a conduit in fluid communication with the porous dielectric material, the improvement comprising the electrodes, wherein the electrodes are comprised of a material having a capacitance of at least $10^{-4}$ Farads per square centimeter, wherein the electrodes are comprised of carbon paper impregnated with carbon aerogel, and wherein the electrokinetic device is laminated.

24. In an electrokinetic device, configured to move fluid flow, comprising a pair of electrodes and a porous dielectric material between the electrodes, the improvement comprising the electrodes being sufficiently proximate to the porous dielectric material so that when there is a voltage drop between the electrodes, the voltage drop across the porous dielectric material is at least 10% of the voltage drop between the electrodes, wherein the electrodes are comprised of a material having a capacitance of at least $10^{-4}$ Farads per square centimeter and wherein the electrokinetic device is capable of generating fluid flow at a rate of at least 1 ml/min.

* * * * *